US010787795B2

(12) United States Patent
George

(10) Patent No.: US 10,787,795 B2
(45) Date of Patent: Sep. 29, 2020

(54) AGGREGATE CRUSHING TOOL

(71) Applicant: WEAR-TECH INDUSTRIES LTD., Calgary (CA)

(72) Inventor: Darryl Anthony George, Calgary (CA)

(73) Assignee: Wear-Tech Industries Ltd., Calgary, Alberta (CA)

( * ) Notice: Subject to any disclaimer, the term of this patent is extended or adjusted under 35 U.S.C. 154(b) by 569 days.

(21) Appl. No.: 14/529,961

(22) Filed: Oct. 31, 2014

(65) Prior Publication Data

US 2015/0211213 A1 Jul. 30, 2015

Related U.S. Application Data

(60) Provisional application No. 61/931,188, filed on Jan. 24, 2014.

(51) Int. Cl.

| | |
|---|---|
| ***E02F 9/28*** | (2006.01) |
| ***C21D 1/18*** | (2006.01) |
| ***E21C 35/18*** | (2006.01) |
| ***B28D 1/18*** | (2006.01) |
| ***C21D 6/00*** | (2006.01) |
| ***C21D 9/00*** | (2006.01) |
| ***C22C 38/02*** | (2006.01) |
| ***C22C 38/04*** | (2006.01) |
| ***C22C 38/22*** | (2006.01) |
| ***C22C 38/24*** | (2006.01) |

(52) U.S. Cl.

CPC ..... *E02F 9/285* (2013.01); *B28D 1/186* (2013.01); *C21D 1/18* (2013.01); *C21D 6/002* (2013.01); *C21D 6/005* (2013.01); *C21D 6/008* (2013.01); *C21D 9/0068* (2013.01); *C22C 38/02* (2013.01); *C22C 38/04* (2013.01); *C22C 38/22* (2013.01); *C22C 38/24* (2013.01); *E21C 35/18* (2013.01)

(58) Field of Classification Search

CPC ..... E02F 9/2808; E02F 9/285; E21C 35/183
USPC ..... 37/460
See application file for complete search history.

(56) References Cited

U.S. PATENT DOCUMENTS 2,066,853 A * 1/1937 Rea ..... C21D 9/22 148/548
3,888,637 A * 6/1975 Taguchi ..... C21D 9/0068 172/747

(Continued)

*Primary Examiner* — Thomas B Will
*Assistant Examiner* — Joan D Misa
(74) *Attorney, Agent, or Firm* — Dickinson Wright LLP; Matthew D. Powell

(57) ABSTRACT

An improved crushing tool for the processing of aggregates, and a heat treatment method for metals used in the fabrication of such tools, is provided. The crushing tool may comprise an attachment portion having a relatively low material hardness and a crushing portion having, in comparison to the attachment portion, a relatively high material hardness. For example, the hardness of the attachment portion may be in the range of 20-35 HRC, and that of the crushing portion may be in the range of 50-60 HRC. Use of tool-grade steel, such as AISI S7 steel, may thereby result in a tool offering a compromise between the hardness (wear-resistance) of the crushing portion and the toughness of the attachment portion. A heat treatment process for the tool-grade steel may involve distinct heating, quenching, and tempering cycles in order to achievable desirable material properties.

7 Claims, 3 Drawing Sheets

(56) References Cited

U.S. PATENT DOCUMENTS

| | | | | | |
|---|---|---|---|---|---|
| 4,277,106 | A * | 7/1981 | Sahley | E02F 9/285 | 125/43 |
| 4,886,710 | A * | 12/1989 | Greenfield | C21D 9/22 | 175/425 |
| 5,141,289 | A * | 8/1992 | Stiffler | E21C 35/183 | 175/435 |
| 5,224,282 | A * | 7/1993 | Swick | E02F 9/285 | 37/453 |
| 7,458,646 | B2 * | 12/2008 | Marathe | E21C 35/183 | 299/110 |
| 7,930,844 | B2 * | 4/2011 | Quarfordt | B28D 1/12 | 37/453 |
| 2008/0048484 | A1 * | 2/2008 | Hall | E21C 35/183 | 299/105 |
| 2008/0084106 | A1 * | 4/2008 | Marathe | E21C 35/183 | 299/110 |
| 2010/0237135 | A1 * | 9/2010 | Hall | E21C 35/183 | 228/121 |
| 2011/0241409 | A1 * | 10/2011 | Swope | B28D 1/186 | 299/111 |
| 2012/0025592 | A1 * | 2/2012 | Hall | E21C 35/183 | 299/106 |

* cited by examiner

AGGREGATE CRUSHING TOOL

CROSS-REFERENCE TO RELATED APPLICATIONS

This application claims the benefit of U.S. Provisional Application Ser. No. 61/931,188, filed Jan. 24, 2014, the entire contents of which are hereby incorporated by reference.

TECHNICAL FIELD

The present disclosure relates generally to wear materials and tools made therefrom, and more particularly to improved apparatus for crushing rocks, aggregate, other forms of earth and minerals, and other materials, and to processes for manufacturing wear materials suitable for use in these and other tools.

BACKGROUND

Grinding teeth and other crushing components, devices, apparatus, or tools, which are used in mining and other types of extraction and reduction equipment to engage and break down rock, soil, minerals, and other materials, are typically subject to significant amounts of wear, and must be replaced frequently. As the replacement of such tools, and parts or components thereof, can involve substantial expense, many solutions for improving the wear resistance of such parts have been proposed. For example, some suppliers provide tools made of tungsten carbide and other materials. Such materials tend, however, to be expensive, and in some cases heavy, and can still require frequent replacement.

Improvement is needed in the wear resistance of such tools, and their components.

SUMMARY

In various aspects, the disclosure provides improved crushing tools, and methods of making and using them. Among the many use or applications to which embodiments of the invention may be advantageously put or directed is the breaking down of aggregate and other types of soil for mining of minerals such as the oil sands in Canada, and other types of drilling and mining operations.

For example, in various aspects the disclosure provides crushing components, such as crushing or grinding teeth, for aggregate-grinding equipment used in mining, drilling, etc. Such tools or components may comprise portions having relatively high hardnesses (e.g., Rockwell hardnesses of HRC 50-60, or equivalent according to other scales) at their crushing surfaces, and relatively lower hardnesses (e.g., HRC 20-35, or equivalent) at other internal locations. The use of such different hardnesses, e.g., by providing separate portions or by gradually decreasing hardness from the crushing surface(s) of a tool toward its interior, can increase both the wear resistance of the tool during contact with material to be broken down, and the tool's toughness during impacts or other contact with the material. As will be appreciated by those skilled in the relevant arts, once they have been made familiar with this disclosure, the use of reduced hardness (and therefore increased toughness) can be of particular importance for shanks or other portions adapted for mounting the tools on further device components, such as rollers or other drive components.

Such components, or tools, can, for example, comprise crushing portions made of improved materials and hardness, for example tool-grade steel having a Rockwell hardness of about HRC 50 to about HRC 60, or any suitable equivalent of such hardness, at their surface. Further, such tools can comprise reduced hardnesses in their interiors or at interior portions. Interior hardnesses can range from about HRC 20-35, for example, in different embodiments.

For example, in some embodiments, crushing components in accordance with the invention can comprise Rockwell hardnesses of not more than about HRC 40 at their interiors. For example, in various embodiments, crushing components in accordance with the disclosure can be provided in the form of crushing or grinding teeth having both crushing or grinding portions, in the form of tips, and shank portions suitable for use in attaching the teeth to drums, heads, or other chassis or carriers. Shanks provided in such embodiments can comprise Rockwell hardnesses of about HRC 40 or less, or the equivalent according to another suitable scale. At that level, such shanks may be susceptible to bending, while at the same time offering resistance to breaking, during engagement of aggregate or other materials, and thereby resulting in overall increased shank toughness.

Tips according to embodiments of the invention may be of substantially conical or frusto-conical form, and shanks may be of substantially cylindrical form shaped for engagement with both the tip and drums, heads, or other chassis or carriers.

As will be appreciated by those skilled in the relevant arts, once they have been made familiar with this disclosure, it can be advantageous, in various circumstances, to produce such teeth, or other crushing components, in the form of assemblies of multiple parts. For example, a crushing component in the form of a tooth can be provided in two or more parts, comprising a grinding tip and a shank; and the tip and shank can be joined by any suitable mechanical or other means, including for example through the use of welding, brazing, adhesives, and/or mechanical fasteners such as bolts or rivets.

Teeth and other crushing components in accordance with the invention can be fabricated using any suitable material(s), i.e., any material(s) having sufficient strength, hardness, durability, corrosion resistance and/or other properties suitable for the purpose to which they are to be put. For example, teeth to be used in grinding or crushing operations for mines and other extraction and/or reduction of soil can be formed of any of a wide variety of metals, including steel. It has been found, for example, that tool grade steels, such as the American Iron and Steel (AISI) S7 series, are particularly advantageous in application such as the Canadian oil sands, particularly when heat treated according to the process(es) described herein.

In further aspects and embodiments, the invention provides processes for making crushing components according to the foregoing. Such a process can, for example, comprise fabricating such components of multiple parts by, for example, forming a crushing portion as a first part and a shank portion as a second part; providing a surface Rockwell hardness of about HRC 50 to about HRC 60 to the first part; providing a Rockwell hardness of not more than about HRC 40 to the second part, for example, in the range of about HRC 20 to HRC 35; and joining the first part to the second part (e.g., by tack welding). Optionally, the hardness of such pieces can decrease gradually from surface portions to interior portions, and particularly shanks or other portions adapted for mounting the tools on further device components, such as rollers or other drive components. The hardness of such mounting components can, in various embodiments, be as low as about HRC 20-35.

In various embodiments, the invention provides processes for making single piece and other crushing components by preparing the component, such as a grinding tooth, and applying heat treatment or other processes such that Rockwell hardnesses of approximately HRC 50-60 (or equivalent) are imparted at the surface of the crushing portion, and gradually decreasing hardnesses are imparted such that hardnesses of approximately HRC 40-50 are imparted at the center(s) for the components.

In various embodiments of such processes, either or both of the desired Rockwell hardnesses (or equivalents) can be imparted by heat treatment. It can be advantageous, in applying such heat treatment, to protect some or all of the components from decarburization and other forms of harmful change. For example, protection from decarburizing can be required, or otherwise desired, in forming high-carbon steels, in order to prevent the formation of undesired carbides in the grain structure, thereby creating brittle points in the steel which could cause cracking and/or fractures, and thus failure of the steel.

The application of heat treatment(s) to provide hardnesses and/or other qualities as described herein can include heating of crushing and/or other portions of a tool in an oven, cooling to achieve desired hardness and wear resistance properties in the materials used, and reheating to reduce the undesired property brittleness created in the hardening process.

As will be understood by those skilled in the relevant arts, it can also be advantageous, in some circumstances, to provide crushing components in accordance with the invention in the form of single, unitary components, through the use of suitable heat treatment methods.

BRIEF DESCRIPTION OF THE DRAWINGS

The invention is illustrated in the figures of the accompanying drawings, which are meant to be exemplary and not limiting, and in which like references are intended to refer to like or corresponding parts.

DETAILED DESCRIPTION

Embodiments of methods, systems, and apparatus according to the invention are described herein throughout with reference to the drawings.

Figure 1:
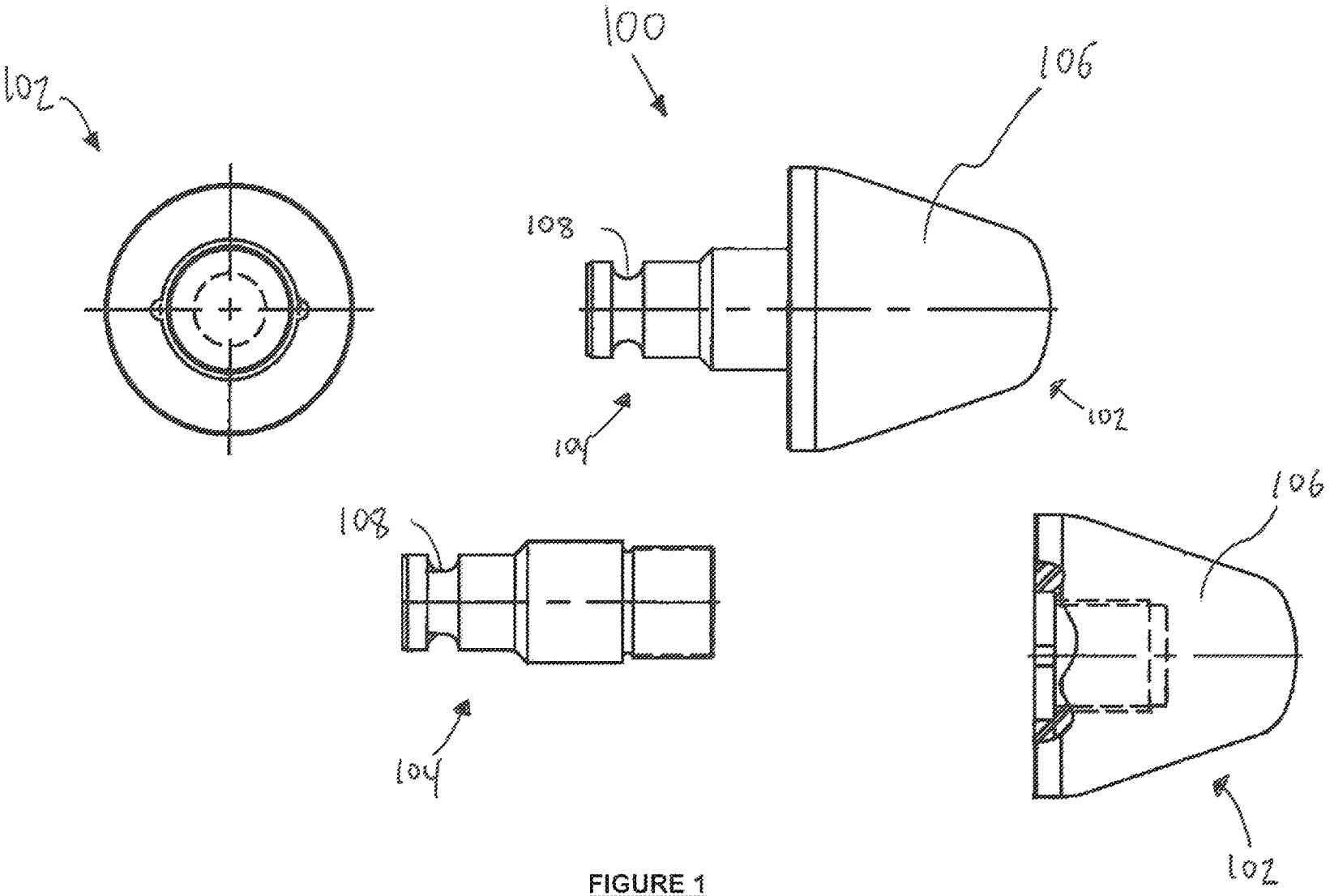
FIG. 1 shows, in various different views, an example embodiment of an aggregate crushing tool in accordance with the invention.

FIG. 1 shows an example embodiment of an aggregate crushing tool, or component, generally denoted 100, in accordance with the invention. In the embodiment shown, tool or component 100 is a crushing or grinding component comprising two parts: a crushing portion 102 in the form of a substantially conical tip, and an attachment portion 104 in the form of a shank for attaching the tool 100 to, or otherwise engaging with, a roller, drill head, or other carrier or chassis (not shown). Such a tool 100 is suitable for, for example, attachment to such a roller, drill head, or other carrier and, upon rotation of the roller, drill head, or carrier, engaging aggregate and/or other soil and, by application of suitable force, crushing and/or grinding it into smaller or otherwise removable chunks, for excavation, etc. Thus, while crushing portion 102 is shown in FIG. 1 as comprising a substantially conical tip, other shapes of a crushing portion 102 may be suitable, such as frusto-conical, as well as other three-dimensional shapes having surfaces or profiles fit for the purposes described herein.

As previously noted, teeth and other crushing components of tools in accordance with the invention can be fabricated using any suitable material(s), i.e., any material(s) having sufficient strength, hardness, durability, corrosion resistance and/or other properties suitable for the purpose to which they are to be put. For example, teeth to be used in grinding or crushing operations for mines and other extraction and/or reduction of soil can be formed of any of a wide variety of metals, including steel. It has been found, for example, that tool grade steels, such as the American Iron and Steel (AISI) S7 series, are particularly advantageous in certain applications, such as for use in the Canadian oil sands, particularly when heat treated as described herein. As will be appreciated by those skilled in the relevant arts, a wide variety of metals may be suitable for use in implementing the invention, through the application of appropriate principles of metallurgy, heat treatment, and other chemical and/or physical processes to create properties required, or otherwise desirable, for breaking down aggregate and/or other materials to sizes or conditions suitable for further desired processing. Such processes can also facilitate easy creation and fabrication of complex shapes, known and never seen before, with carbide overlay processes, etc.

In the embodiment shown in FIG. 1, both crushing portion 102 and attachment portion 104 are formed, e.g., by casting, forging, milling, etc., from tool-grade steel such as AISI S7 shock-resistant tool steel. In other applications or embodiments, different metals may be selected, including for example AISI D2 tool-grade steel, for use in the formation of crushing portion 102 and/or attachment portion 104. In some embodiments, depending on the particular application, crushing portion 102 and attachment portion 104 may be formed from different metals having different properties.

Crushing portion 102 may be heat treated, or otherwise treated (e.g., by appropriate chemical and/or physical processes, such as surface peening; and/or selection of suitable alloys) so that surface 106 is imparted with a hardness that is suitable for its intended application. For example, in an application intended for breaking up soil such as that found in the Canadian oil sands using tools fabricated of AISI S7 steel, crushing portion 102 may be heat treated through a process, described further herein, which will impart surface 106 with a hardness associated with Rockwell hardness numbers in a range from about HRC 50 to HRC 60 or, more specifically, from about HRC 57 to about HRC 60 (or equivalent according to other scale(s)).

In some embodiments, attachment portion 104 of a tool or component 100 may be lathed, milled, forged or otherwise formed or imbued with a shape that facilitates engagement of both crushing portion 102 and a suitably-adapted carrier or chassis, such as a roller or drill head, in any manner suitable for its intended purpose(s). Thus, for example, in the embodiment shown, tool 100 is attachable to a roller or drill head by means of engagement of lock washers, detents, or other mechanical devices in groove or channel 108 that is formed in attachment portion 104.

Attachment portion 104 may be heat treated, or otherwise treated (e.g., by appropriate chemical processes, and/or selection of suitable alloys) so as to impart a hardness that is suitable for its intended application. For example, in an application intended for breaking up soil such as that found in the Canadian oil sands using tools fabricated of AISI S7 steel, attachment portion 104 may be heat treated to a hardness, or alternatively left untreated so as to preserve a pre-existing hardness, which in either case is generally less than the hardness imparted to surface 106 of crushing portion 102. Because in many metals hardness and toughness may generally be inversely related, a relatively lower hardness of attachment portion 104, as compared to crushing portion 102, may also produce a relatively greater toughness. In some cases, a hardness associated with Rockwell hardness numbers of not greater than about HRC 40, or equivalent, may be suitable for attachment portion 104.

Depending upon the application to which the tool 100 is to be put, it may be advantageous, for reason(s) of flexibility, durability, cost, and other factors, to maximize the durability or flexibility (i.e., toughness) of attachment portion 104, so as to maximize the service life of attachment portion 104 and thus the overall life of the tool 100. Because in many metals toughness is an inverse function of hardness, it can therefore be important that attachment portion 104 be less hard, and therefore more tough, than the surface 106 or crushing portion 102.

In some embodiments of tools 100 fabricated of steel for aggregate crushing applications, for example, attachment portion 104 may have a hardness in the range of HRC 25-30 or, more generally, HRC 20-35.

As described further below, the application of heat treatment(s) to provide hardnesses and/or other qualities may include heating of crushing and/or other portions of a tool in an oven or other chamber, combined with quenching in a cool environment so as to achieve desired hardness and wear resistance properties in the materials used. Additional heating or tempering may also be employed so as to reduce the undesired property brittleness created in the hardening process.

In addition to, or as a part of, any heat treatment that may be applied to any or all of parts crushing portion 102, attachment portion 104, etc., further processes may be applied, optionally either separately and/or as a part of controlling the heat treatment process. For example, during a heat treatment process according to the foregoing, it may be advantageous to protect either or both of crushing portion 102 and attachment portion 104 from decarburization. As noted above, protection from decarburization can be useful in preventing formation of undesired carbides in the grain structure, and thus the prevention of brittle points forming in the steel which could cause cracking and/or fractures that might ultimately lead to the failure of the steel when stressed.

As will be understood by those skilled in the relevant arts, the shape(s) and/or dimension(s) of tool 100, or of any part or component thereof, such as crushing portion 102 and attachment portion 104, may be defined, either wholly or partially, by the use or application to which such tool(s) 100 and/or parts are to be put. In an embodiment of a tool or component 100 to be used in mining or other crushing or grinding of aggregate and/or other types of soil, use of a substantially conical or frusto-conical shape of maximum diameter of about 7 inches, and total axial length of about 6 and 9/16ths inches for crushing portion 102, as shown in FIG. 1, may be advantageous. In the same or a different embodiment, use of a simple or complex cylindrical shape of about 2 and 3/8 inch maximum diameter for shank 104 may be utilized. Other embodiments of aggregate or other earth-processing tools can be provided in the form of, for example, teeth for single or double-roll crushers, including teeth of a very wide variety of shapes and sizes, depending upon the working material (e.g., earth, stone, etc.) and the purpose of the processing thereof; and/or jaw crushers, bucket teeth, etc. Thus, a very wide variety of shapes can be provided in accordance with the invention.

Use of the processes and tools described herein have been shown in some, but not necessarily all, applications to provide as much as approximately four times (400%) the useful service life available through use of certain previously-known tools. Other applications, such as serrations on knife blades, grooves in hammers, etc., are expected to yield similar results.

In some embodiments, following formation, and/or optional heat and/or chemical treatment, crushing portion and attachment portion 104 may be joined, engaged, coupled, or otherwise assembled together in a tool 100. For example, in the embodiment shown in FIG. 1, crushing portion 102 and attachment portion 104 may be joined by tack welding. However, any suitable mechanism of coupling may be employed, including mechanical and/or chemical or adhesive fastening of any suitable type.

Figure 2:
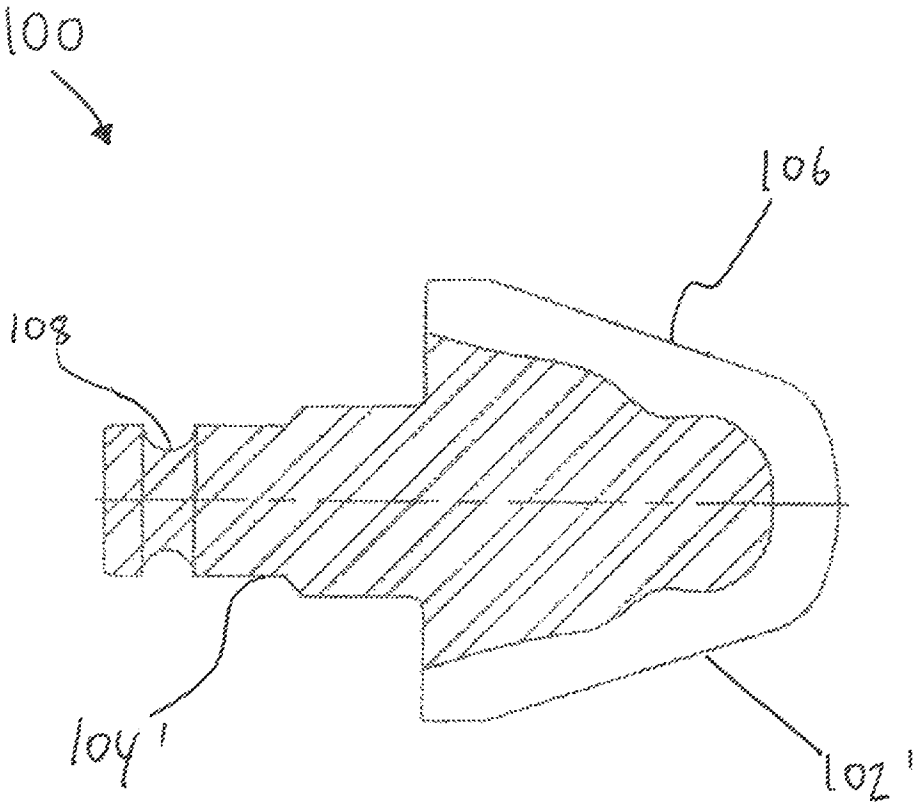
FIG. 2 shows, in side profile view, another example embodiment of an aggregate crushing tool in accordance with the invention.

Referring now to FIG. 2, there is shown another embodiment of an aggregate crushing tool or component 100 in accordance with the invention. In the embodiment shown, tool or component 100 is a crushing or grinding component formed of a single or unitary part, comprising at least two portions: a crushing portion 102' in the form of a substantially conical tip, and a shank portion 104' for attaching the tool 100 to, or otherwise engaging, a roller, drill head, or other carrier or chassis (not shown). Such a tool 100 may be suitable for, for example, attachment to such a roller, drill head, or other carrier and, upon rotation of the roller, drill head, or carrier, engaging aggregate and/or other soil and, by application of suitable force, crushing and/or grinding it into smaller or otherwise removable chunks, for excavation, etc.

In the embodiment shown in FIG. 2, being portions of a single or unity part, both crushing portion 102' and shank portion 104' may be formed, e.g., by casting, forging, milling, etc., from of a single metal body or preform, which may be a tool-grade steel such as AISI S7 shock-resistant tool steel. In other applications and embodiments, however, a different metal may be selected, for example, including any of the AISI D2, D3, H13, etc., tool-grade steels. Any suitable tool or other steels, or metals may be used, depending on different factors or considerations, such as the intended application or performance specifications defined in terms of one or both of wear and toughness.

In some embodiments, crushing portion 102' can be heat treated, or otherwise treated (e.g., by appropriate chemical processes, and/or selection of suitable alloys) so that surface 106 is imparted with a hardness that is suitable for its intended application. For example, in an application intended for breaking up soil such as that found in the Canadian oil sands using tools fabricated of AISI S7 steel, crushing portion 102' may be heat treated through a process, described further herein, which will impart surface 106 with a hardness associated with Rockwell hardness numbers in a range from about HRC 50 to HRC 60 or, more specifically, from about HRC 57 to about HRC 60 (or equivalent according to other scale(s)).

The hardness imparted to surface 106 may also penetrate to a specified depth within the body of crushing portion 102'. For example, for a crushing portion 102' having an outer diameter of approximately 7" (as shown in FIG. 1), the depth to which the specified hardness is imparted may be approximately 1". The hardness may further decrease as a function of depth within the crushing portion 102', such that in shank portion 104', the hardness does not exceed an HRC of about 40 or, in some cases, falls within a range of about HRC 25-30 or, more generally, HRC 20-35.

For example, a one-piece tool 100 having graduated hardness/toughness between surface 106 and shank portion(s) 104' may be produced by casting or forging the desired shape of tool 100 using a single or unitary piece of a selected metal, such as tool-grade steel, and performing suitable heat treatment processe(s) as described herein. Shank portion(s) 104' may additionally be annealed using, for example, an induction coil so as to impart a hardness within the range of HRC 20-35 HRC (e.g., in the case of nickel-chrome steel). Such additional process(es) may have little or no appreciable impact on the hardness of crushing portion 102', which may thereby be maintained in a range of about HRC 50-60 or some other desired hardness that provides a desired wear resistance.

Figure 3:
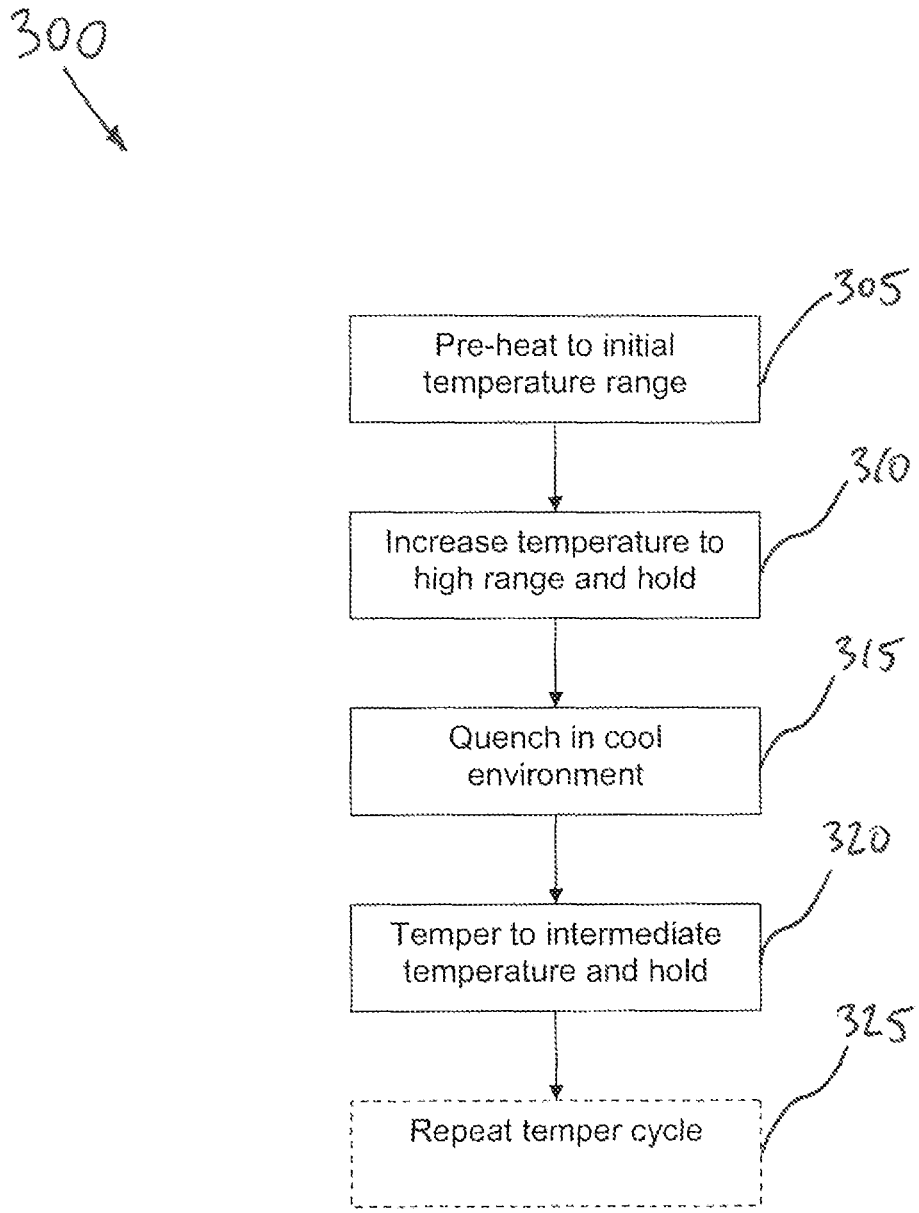
FIG. 3 shows, in a flow chart, a method for heat treatment of a material, in accordance with the invention.

Referring now to FIG. 3, there is illustrated, in a flow chart, a method 300 for heat treatment of a material, in accordance with the invention. Method 300 may be applied to a variety of different suitable materials, including tool-grade steel, such as AISI S7, in order to increase material hardness to a specified or desired level. As described herein, for example, method 300 may be effective to impart different metals with a hardness in the range of about HRC 50-60. While depicted as an ordered series of discrete steps, it will be appreciated that (unless otherwise stated explicitly or implied by context), the depicted sequence may be altered or varied, including the addition of steps not explicitly shown, as well as by the combination or splitting of steps.

In the embodiment shown, method 300 may commence at 305 by pre-heating a material to an initial temperature range that may be approximately 1200-1300 degrees Fahrenheit, for example, in an oven or other temperature-controllable vessel or chamber. At 310, the temperature of the material may be raised past a critical material temperature to a cook temperature, at which temperature the material may be held for a selected period of time. The cook temperature may be within a range of temperatures from about 1650 to 1850 degrees Fahrenheit or, more specifically, 1700 to 1775 degrees Fahrenheit. In some cases, the cook temperature may be approximately 1725 degrees Fahrenheit. The period of time at which the material is held at the selected cook temperature may be 2 hours or some other time period within a range of about 1.5 to 3 hours, depending on other considerations such as the thickness of the material.

At the end of the selected period of time, at 315, the material may be quenched in a relatively cool environment, for example, still air or other inert gas(es), until the material temperature has been reduced to a lower range, such as 125 to 240 degrees Fahrenheit, at which material hardening takes place. In some cases, the hardening temperature may be about 150 degrees Fahrenheit, although other hardening temperatures are possible as well.

At 320, 325, the material may be tempered one or more (e.g., two) times through heating or reheating to a selected intermediate temperature, so as to increase the toughness of the material (which may be relatively brittle following quenching). A suitable temperature range for tempering of the material may be about 325 to 450 degrees Farhenheit or, more specifically, about 400 to 450 degrees Fahrenheit. In some cases, the material may be tempered at about 425 degrees Fahrenheit and held at that temperature for a further period of time, such as two hours, or some other period of time between 1.5 and 3 hours, depending again on the physical properties (e.g., thickness) of the material being treated. While some embodiments may utilize only a single temper cycle (320), a second temper cycle (325) may be advantageous in some cases.

In addition to, or as a part of, method 300 for heat treatment of a material, further processes may be applied, optionally either separately and/or as a part of controlling the heat treatment process. For example, during a heat treatment process according to the foregoing, it may be advantageous to protect the material being treated from decarburization.

Method 300 may be effectively utilized to treat a range of materials for which a specified hardness of about HRC 50-60 may be required, desired, or which may otherwise be advantageous or provided. For example, without limitation, method 300 may be utilized in the fabrication of a crushing tool or component 100 (embodiments of which are shown in FIGS. 1 and 2). Thus, heat treatment processes 300 may be utilized in the fabrication of a discrete crushing portion 102 of a tool 100 (FIG. 1), as well as in the fabrication of a graduated crushing portion 102' included as part of a unitary tool 100 (FIG. 2). However, applications of method 300 are not limited just to fabrication of tools 100, as described herein, and may have further uses in the fabrication of other tools, devices and apparatus directed to other applications.

As previously discussed, the shape(s) and dimensions of tools 100, and of crushing portion 102, attachment portion 104, etc., may be defined, wholly or partially, by the use to which such tools 100 and/or parts and components are to be put. For example, for a tool or component 100 to be used in mining or other crushing or grinding of aggregate and/or other types of soil, the use of a substantially conical or frustoconical shape for crushing portion 102, and/or of a simple or complex cylindrical shape for attachment portion 104, may be advantageous. The dimensions of such tool 100 and its constituent may vary, but for the particular application of mining or other crushing or grinding of aggregate and/or other types of soil, example dimensions as described herein may be suitable.

It has been found that the use of tool-grade steel in such applications, where it was previously unknown, both created challenges and, when those challenges were solved, as described herein, resulted in the creation of a suitable tool steel and heat treatment which would meet the requirements of the application while exceeding the life times of existing designs.

While the disclosure has been provided and illustrated in connection with specific, presently-preferred embodiments, many variations and modifications may be made without departing from the spirit and scope of the invention(s) disclosed herein. The disclosure and invention(s) are therefore not to be limited to the exact components or details of methodology or construction set forth above. Except to the extent necessary or inherent in the processes themselves, no particular order to steps or stages of methods or processes described in this disclosure, including the Figures, is intended or implied. In many cases the order of process steps may be varied without changing the purpose, effect, or import of the methods described.

The scope of the invention is to be defined solely by the appended claims, giving due consideration to applicable doctrines of claim construction, such as purposive construction, the doctrine of equivalents, and related doctrines. As will be appreciated by those skilled in the relevant arts, various features of the above-described aspects and embodiments may be combined to create alternative embodiments not explicitly described, but which are specific instances of broader or more generic embodiments that have been disclosed. The disclosure herein is specifically intended to cover and embrace all suitable changes in technology.

The invention claimed is:

1. An aggregate crushing tool comprising:

an attachment portion for mounting the tool on a chassis, the attachment portion comprising a bendable cylindrical shank defined by a first hardness with the range 20-30 HRC; and a crushing portion supported on the attachment portion, the crushing portion comprising a conical or frusto-conical shaped body defined by a second hardness that is greater than the first hardness, wherein the attachment portion and the crushing portion are integrally formed, and the hardness of the crushing portion is graduated inwardly from a surface of the crushing portion toward the attachment portion.

2. An aggregate crushing tool comprising:

an attachment portion for mounting the tool on a chassis, the attachment portion comprising a bendable cylindrical shank defined by a first hardness with the range 25-30 HRC; and a crushing portion supported on the attachment portion, the crushing portion comprising a conical or frusto-conical shaped body defined by a second hardness that is greater than the first hardness.

3. The tool of claim 2, wherein the second hardness is within the range 50-60 HRC.

4. The tool of claim 3, wherein the second hardness is within the range 57-60 HRC.

5. An aggregate crushing tool comprising:

an attachment portion for mounting the tool on a chassis, the attachment portion comprising a bendable cylindrical shank defined by a first hardness with the range 20-30 HRC; and a crushing portion supported on the attachment portion, the crushing portion comprising a conical or frusto-conical shaped body defined by a second hardness that is greater than the first hardness, wherein the second hardness is within the range 50-60 HRC.

6. The tool of claim 5, wherein the second hardness is within the range 57-60 HRC.

7. An aggregate crushing tool comprising:

an attachment portion for mounting the tool on a chassis, the attachment portion comprising a bendable cylindrical shank defined by a first hardness with the range 20-30 HRC; and a crushing portion supported on the attachment portion, the crushing portion comprising a conical or frusto-conical shaped body defined by a second hardness that is greater than the first hardness, wherein the attachment portion and the crushing portion are each formed of AISI S7 steel.

* * * * *